US009402428B2

(12) United States Patent
Miers

(10) Patent No.: US 9,402,428 B2
(45) Date of Patent: Aug. 2, 2016

(54) NOSE CUP FOR DENTAL AND OTHER SURGICAL PROCEDURES

(71) Applicant: Martha Miers, Richland, WA (US)

(72) Inventor: Martha Miers, Richland, WA (US)

( * ) Notice: Subject to any disclaimer, the term of this patent is extended or adjusted under 35 U.S.C. 154(b) by 387 days.

(21) Appl. No.: 14/155,251

(22) Filed: Jan. 14, 2014

(65) Prior Publication Data

US 2015/0196075 A1 Jul. 16, 2015

(51) Int. Cl.
*A41D 13/11* (2006.01)
*A42B 3/20* (2006.01)

(52) U.S. Cl.
CPC ..... *A41D 13/1146* (2013.01); *A42B 3/20* (2013.01); *Y10T 29/49826* (2015.01)

(58) Field of Classification Search
CPC ..... A42B 3/20; A41G 7/00; A61F 9/04; A61M 16/06
USPC ..... 2/9, 206; 128/858, 206.21
See application file for complete search history.

(56) References Cited

U.S. PATENT DOCUMENTS 1,070,584 A * 8/1913 Byron ..... A41D 13/11 2/206
1,436,313 A * 11/1922 Hafer ..... A61F 13/126 2/206
3,594,813 A * 7/1971 Sanderson ..... A61F 13/126 128/857
5,243,708 A * 9/1993 Vanuch ..... A41D 13/1176 128/206.24
5,682,607 A * 11/1997 Klein ..... A61F 13/126 128/858
6,070,265 A * 6/2000 Tasbas ..... A41D 13/11 128/858
6,116,236 A * 9/2000 Wyss ..... A61F 5/08 128/200.24
6,196,228 B1 * 3/2001 Kreitzer ..... A61F 5/08 128/200.24
8,555,413 B2 * 10/2013 Beliveau ..... A61F 9/029 2/9

* cited by examiner

*Primary Examiner* — Tejash Patel
(74) *Attorney, Agent, or Firm* — Floyd E. Ivey

(57) ABSTRACT

The Nose Cup (1) invention is a single layer or a multilayer fabric formed or shaped or is folded to cover the nose. The shape is accomplished in these by a forming process including by folding a multilayer fabric. In the preferred embodiment a moldable or foldable fabric is formed into a generally polyhedron with an elongated common vertex shape amenable to fitting over a nose. A bendable band (230) or wire (220) at either or both a top (160) or a bottom (200) is contained within or attached to the fabric. The folded nose cup (1) covers the nose and the bendable band (230) or wire (220) is compressed to either the contour of the bridge of the nose and or beneath the nose and nostrils and a distance up both lateral sides of the nose. As an alternative to molding, a nose cup blank (5) is folded to form the nose cup (1).

6 Claims, 2 Drawing Sheets

NOSE CUP FOR DENTAL AND OTHER SURGICAL PROCEDURES

FIELD OF THE INVENTION

This invention relates to an apparatus, containing aromatic aromas, covering the nose during dental other surgical procedures or in other catastrophic circumstances where repugnant odors exist. More specifically the invention is a multilayer pleated fabric apparatus shaped to cover the nostrils with the fabric treated or impregnated with aromatic odors.

BACKGROUND OF THE INVENTION

Dental procedures, especially involving abscess, can discharge decay which is malodorous and extremely unpleasant to the patient. The aftermath of disasters, such as hurricanes and war, can leave victims in the path of the calamity where decay occurs. First responders and others needed at the site of such events are subject to undesirable odors. A variety of surgical masks are seen in the literature. This invention claims a mask or cup specifically directed to attachment to the nose with the apparatus overriding unpleasant odors by means of aromatic substances.

SUMMARY OF THE INVENTION

The Nose Cup (1) invention is a single layer or a multilayer fabric which is pleated and formed or shaped or is folded to cover the nose. The shape is accomplished in these by a forming process including by folding a multilayer fabric. In the preferred embodiment a moldable or foldable fabric is formed into a generally polyhedron with an elongated common vertex shape amenable to fitting over a nose. A bendable band (230) or wire (220) at either or both a top (160) or a bottom (200) is contained within or attached to the fabric. The folded nose cup (1) covers the nose and the bendable band (230) or wire (220) is compressed to either the contour of the bridge of the nose and or beneath the nose and nostrils and a distance up both lateral sides of the nose. As an alternative to molding, a nose cup blank (5) is folded to form the nose cup (1).

BRIEF DESCRIPTION OF THE FIGURES

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION OF THE INVENTION

The patents and publications referred to herein are provided herewith in an Information Disclosure Statement in accordance with 37 CFR 1.97.

As seen in FIGS. 1 through 5 and 8 through 11, a nose cup (1) is formed with a shape which can be placed over a nose. Those of ordinary skill in the cup or mask or respirator forming arts know the methods of forming a fabric or material into a multitude of shapes including those represented by N-95 respirators.

Figure 8:
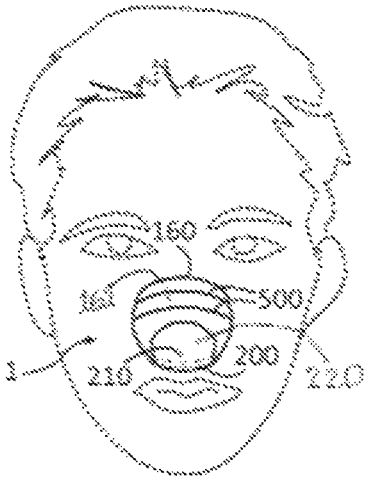
FIGS. 8 and 9 illustrate a front elevation and side elevation views the nose cup (1), top (160), bottom (200), cup bottom (210), bottom clasp (410) and pleats (500).
Figure 9:
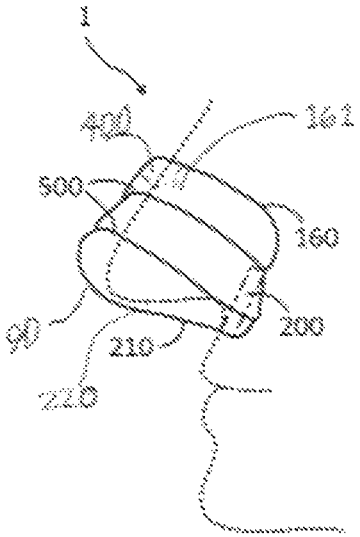
Figure 10:
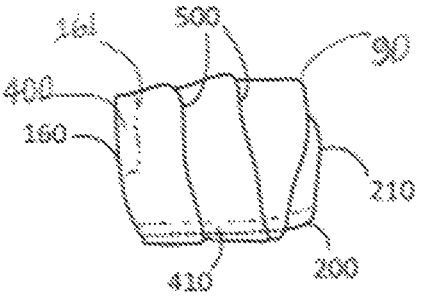
FIG. 10 and FIG. 11 show a side elevation and a perspective view exhibiting the nose cup (1), top (160), bottom (200), cup bottom (210), bottom clasp (410) and pleat (500).
Figure 11:
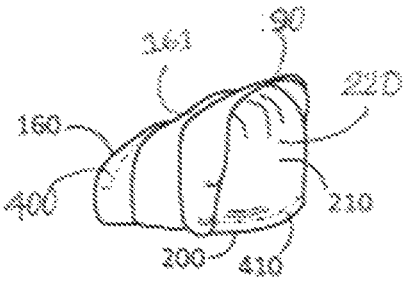

The preferred embodiment claimed for this invention is a nose cup (1) formed by molding a nose cup blank into a generally polyhedron shape with an elongated common vertex, as seen in FIGS. 8 through 10. The molded nose cup (1) has a top (160) and a bottom (200). Intermediate the said top (160) and the said bottom (200) is a common elongated vertex (90) having a width to accommodate the nostrils of a nose. A top clasp (400) formed of a bendable wire or band, formed of an easily bendable material such as aluminum, is fitted at the outer surface or between layers, where a multi-layer material is used, proximal the top (160). The top clasp (400) is bent over the bridge of the nose to secure the nose cup (1) to the nose.

A bottom (200) is distal from the top (160) and is formed to fit under the nostrils and up both sides of the nostrils. A cup bottom (210) extending from the bottom (200) to the elongated vertex (90). The said cup bottom (210) is positioned under and proximal the nostrils and is treated with an aromatic substance intended to treat a dental or surgical patient to an odor other than the malodorous aromas arising from some dental procedures. A bottom clasp (410) formed of a bendable wire or band, formed of an easily bendable material such as aluminum, is fitted at the outer surface or between layers, where a multi-layer material is used, proximal the bottom (200). The bottom clasp (410) is bent upwardly around the nostrils to secure the nose cup (1) to the nose. A cup top (161) extends from the said top (160) to the elongated vertex (90) and covers the nose from bridge to the tip of the nose.

Another embodiment claimed for this invention is a nose cup (1) formed by folding a generally planar octagonal nose cup blank (5) having a top (160) side, a right top (170) side adjoining the said top (160), a right middle (180) side adjoining the said right top (170), a right bottom (190) adjoining the said right middle (180) side, a bottom (200) adjoining the said right bottom (190) side and which is generally parallel to the said top (160). A left bottom (191) adjoining the said bottom (200), a left middle (181) adjoining the said left bottom (191), a left top (171) side adjoining the said left middle (181) side and said left top (171) adjoining the said top (160) side.

A midline (90), corresponding to a common elongated vertex when the folding is completed, generally bisects the nose cup blank (5) from the said right middle (180) side to the said left middle (181) side. A fold point right (92) is incidental to the midline (90) and is proximal the said right middle (180). A fold point left (94) is incidental to the midline (90) and is proximal the said left middle (180). A right top fold (130) line from mid right top (170) extending to the said fold point right (92); a right mid fold (140) line extending from mid right middle (180) to the said fold point right (92) and a right bottom fold (150) line extending from mid right bottom (190) to said fold point right (92). A left top fold (131) line from mid left top (171) extending to the said fold point left (94); a left mid fold (141) line extending from mid left middle (181) to the said fold point left (94) and a left bottom fold (151) line extending from mid left bottom (191) to said fold point left (94).

Figure 1:
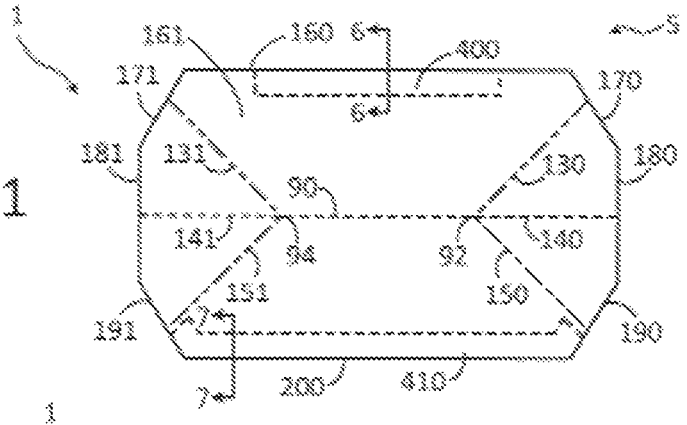
FIGS. 1 through 5 illustrates the nose cup (1) formed by folding a generally octagnally shaped nose cup blank (5) having a top (160), midline (90), fold point right (92), fold point left (94), right top (170), right middle (180), right bottom (190), bottom (200), left top (171), left middle (181), left bottom (191), right top fold (130), right mid fold (140), right bottom fold (150), left top fold (131), left mid fold (141), left bottom fold (151), top clasp (400) and bottom clasp (410). It is seen that FIGS. 2 through 5 illustrate a folding process resulting in a generally polyhedron with an elongated common vertex shape at the midline (90) intended to accommodate the width of the nose at the nostrils. Also seen in FIGS. 2 through 5 is a cup top (161) and cup bottom (210).
Figure 6:
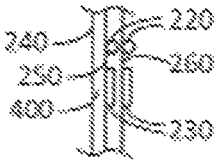
FIGS. 6 and 7 show sections 6 and 7 from FIG. 1 illustrating multi-layer fabric (500) showing fabric layer first (240), fabric layer second (250), fabric layer nth (260), top clasp wire (220), top clasp band (230), bottom clasp wire (220) and bottom clasp band (230).
Figure 2:
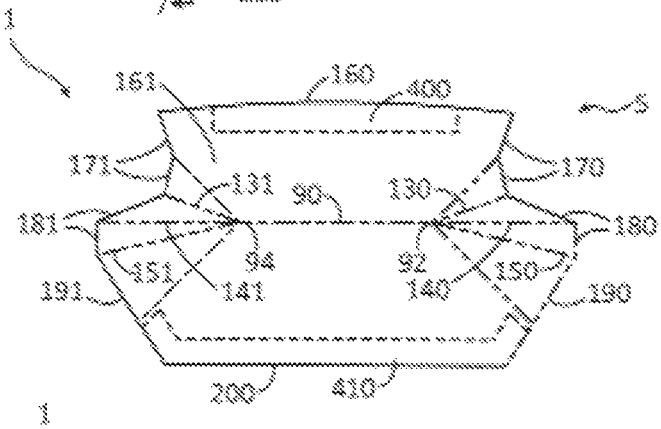
Figure 7:
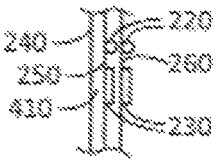
Figure 3:
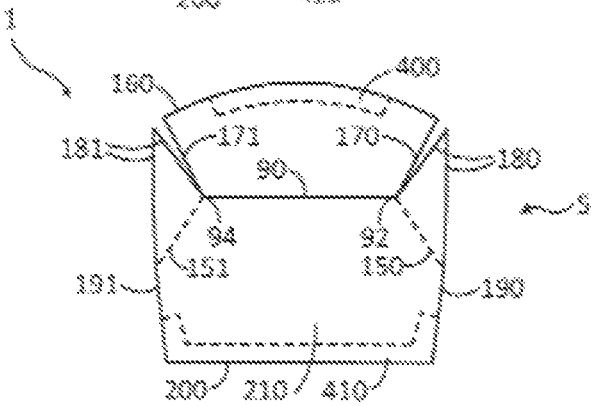

As seen in FIG. 2, fold the right top fold (130) inward toward the midline (90). Fold the right mid fold (140) line outward and upward, as seen in FIG. 3, to contact the fold created by folding the right top fold (130) inward toward the midline (90). Fold the left top fold (131) inward toward the midline (90). Fold the left mid fold (141) line outward and upward, as seen in FIG. 3, to contact the fold created by folding the left top fold (131) inward toward the midline (90). These folds cause the top (160) to concavely curve relative to the midline (90).

Figure 4:
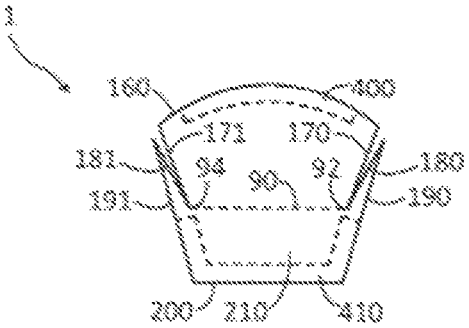
Figure 5:
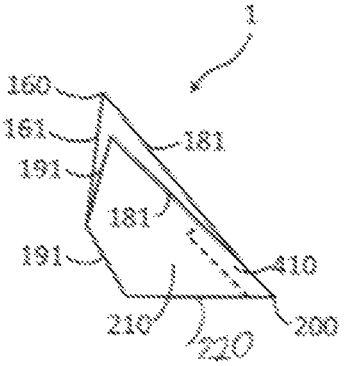

As seen in FIG. 4, fold the right bottom fold (150) outward and upward into contact with the right mid fold (140). Fold the left bottom fold (151) outward and upward into contact with the left mid fold (141). These folds cause the top (160) to an increased concave curve relative to the midline (90). These folds cause the bottom (200) to concavely curve upwardly toward the top (160) and, the most distal portions of the bottom (200) to bend upwardly along the outside of the nose cup (1). A cup bottom (210) is formed between the bottom (200) and the midline (90).

The fabric forming the nose cup blank (5) may be single ply or may be multi-ply material and is, at least at the cup bottom (210), scented with an aromatic substance. A bendable, elongated and non-elastic bottom clasp (410) affixed to the nose cup blank (5) proximal to and or coinciding with the bottom (200) and the cup bottom (210) distal to the top (160). The bottom clasp (410) can be at the outside of the nose cup blank (5) and the finally assembled nose cup (1) or, where the nose cup (1) is formed of a multi-ply material, between two layers of the multi-ply material. The said bottom clasp (410), at it distal portions, is bent upwardly along side the nostril to secure the nose cup (1) to the patient's nose. A bendable, elongated and non-elastic top clasp (400) is affixed to the nose cup blank (5) proximal to and or coinciding with the top (160) and the cup top (161) distal to the bottom (200). The said top clasp (400) is bent downwardly along side of the bridge of the nose to secure the nose cup (1) to the patient's nose. The said top clasp (400) and the said bottom clasp are affixed with clasp affixing methods which include applying by use of an adhesive, by use of stitching and by other methods known by those of ordinary skills in the clasp affixing arts.

The invention claimed is:

1. A method of forming a nose cup (1) comprising:

forming a nose cup blank (5) into a generally polyhedron shape with an elongated common vertex; the nose cup blank (5) having a top edge (160) and a bottom edge (200); intermediate the top edge (160) and the bottom edge (200) is the common elongated vertex (90) having a width to accommodate the nostrils of a nose; and forming a top clasp (400), of a bendable non-elastic material, which is affixed to the nose cup (1) proximal to the top edge (160); and forming a bottom edge (200) which is distal from the top edge (160) and is formed to fit under the nostrils and up both sides of the nostrils; and forming a cup bottom (210) extending from the bottom edge (200) to the elongated vertex (90); the cup bottom (210) is positioned under and proximal the nostrils and is treated with an aromatic substance (220); and a bottom clasp (410) formed of a bendable non-elastic material and is affixed to the nose cup (1) proximal the bottom edge (200); the bottom clasp (410) is bent upwardly around the nostrils to secure the nose cup (1) to the nose; and a cup top (161) which extends from the said top (160) to the elongated vertex (90) and covers the nose from bridge to the tip of the nose.

2. The method of claim 1 further comprising:

the top clasp (400) and the bottom clasp (410) are formed of an easily bendable material, including aluminum; and the top clasp (400) is affixed with clasp affixing methods, at the outer surface of the cup top (161) proximal the top (160) and the bottom clasp (410) is affixed with clasp affixing methods at the outer surface of the nose cup (1) proximal the bottom edge (200).

3. The method of claim 1 further comprising:

the top clasp (400) and the bottom clasp (410) are formed of an easily bendable material, including aluminum; and the top clasp (400) is affixed with clasp affixing methods, where a multi-layer material is used, between two layers proximal the top (160) and the bottom clasp (410) is affixed with clasp affixing methods, where a multi-layer material is used, between two layers proximal the top edge (160).

4. A nose cup (1) comprising:

forming a generally planar octagonal nose cup blank (5) from a foldable material; the nose cup blank (5) having a top (160) side, a right top (170) side adjoining the the top side (160), a right middle (180) side adjoining the right top side (170), a right bottom edge (190) adjoining the said right middle (180) side, a bottom edge (200) adjoining the right bottom (190) edge and which is generally parallel to the top side (160); a left bottom edge (191) adjoining the bottom edge (200), a left middle (181) adjoining the left bottom edge (191), a left top (171) side adjoining the left middle (181) side and said left top side (171) adjoining the top (160) side; a midline (90) generally bisects the nose cup blank (5) from the right middle (180) side to the left middle (181) side; a fold point right (92) is incidental to the midline (90) and is proximal the right middle side (180); a fold point left (94) is incidental to the midline (90) and is proximal the left middle side (180); a right top fold (130) line from side (170) extending to the fold point right (92); a right mid fold (140) line extending from mid right middle side (180) to the said fold point right (92) and a right bottom fold (150) line extending from mid right bottom (190) to said fold point right (92); a left top side fold (131) line from mid left top side (171) extending to the fold point left (94); a left mid fold (141) line extending from mid left middle (181) to the said fold point left (94) and a left bottom fold (151) line extending from mid left bottom edge (191) to said fold point left (94); and folding as follows: the right top fold (130) inward toward the midline (90); the right mid fold (140) line outward and upward to contact the fold created by folding the right top fold (130) inward toward the midline (90); the left top fold (131) inward toward the midline (90); the left mid fold (141) line outward and upward to contact the fold created by folding the left top fold (131) inward toward the midline (90); and these folds causing the top (160) to concavely curve relative to the midline (90) forming a nose cup top (161); and folding as follows: the right bottom fold (150) outward and upward into contact with the right mid fold (140); the left bottom fold (151) outward and upward into contact with the left mid fold (141); and these folds causing the top (160) to an increased concave curve relative to the midline (90) and causing the bottom edge (200) to concavely curve upwardly toward the top side (160) and, the most distal portions of the bottom edge (200) to bend upwardly along the outside of the nose cup (1) and forming a cup bottom (210) between the bottom edge (200) and the midline (90); and affixing a bendable, elongated and non-elastic bottom clasp (410) to the nose cup blank (5) proximal to the bottom edge (200) and distal to the top (160); and in applying the nose cup (1) to the patient, bending the said bottom clasp (410), at it distal portions, upwardly along side the nostril to secure the nose cup (1) to the patient's nose; and affixing a bendable, elongated and non-elastic top clasp (400) to the nose cup blank (5) proximal to the top side (160) and distal to the bottom edge (200); and in applying the nose cup (1) to the patient, bending the said top clasp (400) downwardly along the sides of the bridge of the nose to secure the nose cup (1) to the patient's nose; and treating the cup bottom (210) with an aromatic substance.

5. The nose cup (1) depending from claim 4 further comprising:

forming the nose cup blank (5) from a single ply material.

6. The nose cup (1) depending from claim 4 further comprising:

Forming the nose cup blank (5) from a multi-ply material.

* * * * *